US010400299B2

(12) United States Patent
Miyamoto et al.

(10) Patent No.: US 10,400,299 B2
(45) **Date of Patent: *Sep. 3, 2019**

(54) HIGH-CARBON HOT-ROLLED STEEL SHEET AND METHOD FOR MANUFACTURING THE SAME

(71) Applicant: JFE STEEL CORPORATION, Tokyo (JP)

(72) Inventors: Yuka Miyamoto, Kawasaki (JP); Takashi Kobayashi, Chiba (JP); Chikara Kami, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 142 days.

This patent is subject to a terminal disclaimer.

(21) Appl. No.: 14/903,911

(22) PCT Filed: Jul. 8, 2014

(86) PCT No.: PCT/JP2014/003612

§ 371 (c)(1),
(2) Date: Jan. 8, 2016

(87) PCT Pub. No.: WO2015/004906

PCT Pub. Date: Jan. 15, 2015

(65) Prior Publication Data

US 2016/0145710 A1 May 26, 2016

(30) Foreign Application Priority Data

Jul. 9, 2013 (JP) ..... 2013-143306

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/60*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/18*** | (2006.01) |
| ***C21D 6/00*** | (2006.01) |
| ***C22C 38/32*** | (2006.01) |
| *C21D 1/32* | (2006.01) |

(52) U.S. Cl.

CPC ..... *C21D 9/46* (2013.01); *C21D 6/005* (2013.01); *C21D 6/008* (2013.01); *C21D 8/0205* (2013.01); *C21D 8/0226* (2013.01); *C21D 8/0263* (2013.01); *C22C 38/00* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/18* (2013.01); *C22C 38/32* (2013.01); *C22C 38/60* (2013.01); *C21D 1/32* (2013.01); *C21D 2211/003* (2013.01); *C21D 2211/005* (2013.01)

(58) Field of Classification Search

CPC ..... C21D 1/32; C21D 2211/003; C21D 2211/005; C21D 6/005; C21D 6/008; C21D 8/0205; C21D 8/0226; C21D 8/0263; C21D 9/46; C22C 38/00; C22C 38/001; C22C 38/002; C22C 38/008; C22C 38/02; C22C 38/04; C22C 38/06; C22C 38/08; C22C 38/12; C22C 38/18; C22C 38/32; C22C 38/60

See application file for complete search history.

(56) References Cited

U.S. PATENT DOCUMENTS

| | | | | |
|---|---|---|---|---|
| 2009/0308504 | A1* | 12/2009 | Kariya | C22C 38/02 148/645 |
| 2011/0017363 | A1 | 1/2011 | Kang et al. | |
| 2012/0006451 | A1 | 1/2012 | Abe et al. | |
| 2013/0186526 | A1 | 7/2013 | Nakamura et al. | |

FOREIGN PATENT DOCUMENTS

| | | | |
|---|---|---|---|
| CN | 1366558 | A | 8/2002 |
| CN | 101910439 | A | 12/2010 |
| CN | 102803541 | A | 11/2012 |
| EP | 1191114 | A1 | 3/2002 |
| JP | H09-78184 | A | 3/1997 |
| JP | 2001-026841 | A | 1/2001 |
| JP | 2001-073033 | A | 3/2001 |
| JP | 2001073033 | A * | 3/2001 |
| JP | 2006-045679 | A | 2/2006 |
| JP | 2008303415 | A | 12/2008 |

(Continued)

OTHER PUBLICATIONS

Sep. 5, 2016 Office Action issued in Chinese Patent Application No. 201480039479.8.

(Continued)

*Primary Examiner* — Colleen P Dunn

*Assistant Examiner* — Anthony M Liang

(74) *Attorney, Agent, or Firm* — Oliff PLC

(57) ABSTRACT

There is provided a high-carbon hot-rolled steel sheet and method for producing the same. The steel sheet has excellent hardenability consistently, even when annealed in a nitrogen atmosphere, and excellent workability. The steel sheet has a hardness in the range of 65 or less in terms of HRB and a total elongation El of 40% or more before a quenching treatment is performed.

6 Claims, No Drawings

(56) References Cited

FOREIGN PATENT DOCUMENTS

| | | | | |
|---|---|---|---|---|
| JP | 2010-255066 | A | | 11/2010 |
| JP | 2010255066 | A | * | 11/2010 |
| WO | 9806881 | A1 | | 2/1998 |
| WO | 2013/102982 | A1 | | 7/2013 |

OTHER PUBLICATIONS

Jul. 5, 2016 Extended European Search Report issued in European Patent Application No. 14823574.0.
Sep. 9, 2014 Search Report issued in International Application No. PCT/JP2014/003612.
May 24, 2018 Office Action issued in U.S. Appl. No. 14/903,842.
Dec. 21, 2018 Office Action issued in U.S. Appl. No. 14/903,842.

* cited by examiner

HIGH-CARBON HOT-ROLLED STEEL SHEET AND METHOD FOR MANUFACTURING THE SAME

This application relates to a high-carbon hot-rolled steel sheet excellent in terms of hardenability and workability and a method for manufacturing the steel sheet and, in particular, to a high-carbon hot-rolled steel sheet to which B is added and which is highly effective for suppressing nitriding in its surface layer and a method for manufacturing the steel sheet.

BACKGROUND

Nowadays, automotive parts such as gears, transmissions, and seat recliners are often manufactured by forming a hot-rolled steel sheet, which is carbon steel material for machine structural use prescribed in JIS G 4051, into desired shapes by using a cold forming method and by performing a quenching treatment on the formed steel sheet in order to achieve desired hardness. Therefore, a hot-rolled steel sheet, which is a raw material for parts, is required to have excellent cold formability and hardenability, and various steel sheets have been proposed to date.

For example, Patent Literature 1 discloses a method for manufacturing a softened medium- or high-carbon steel sheet, the method including cold-rolling a hypoeutectoid hot-rolled steel sheet having a chemical composition containing, by mass %, C: 0.1% to 0.8%, Si: 0.15% to 0.40% and Mn: 0.3% to 1.0%, limiting P: 0.03% or less, S: 0.01% or less and T.Al: 0.1% or less, and the balance being Fe and incidental impurities with a soft reduction of 20% or more and 30% or less, sequentially performing three-step annealing including first heating in which the cold-rolled steel sheet is held at a temperature equal to or higher than the Ac1 transformation temperature −50° C. and lower than the Ac1 transformation temperature for 0.5 hours or more (exclusive of a soaking time of 6 hours or more), second heating in which the heated steel sheet is held at a temperature equal to or higher than the Ac1 transformation temperature and equal to or lower than Ac1 transformation temperature +100° C. for 0.5 to 20 hours, and third heating in which the heated steel sheet is held at a temperature equal to or higher than the Ar1 transformation temperature −50° C. and equal to or lower than the Ar1 transformation temperature for 2 to 20 hours, in which the cooling rate from the holding temperature of the second heating to the holding temperature of the third heating is 5° C./h to 30° C./h. The object of the invention according to Patent Literature 1 is to soften a medium- or high-carbon hot-rolled steel sheet so that the steel sheet can be satisfactorily subjected to integral forming of a high degree of working while maintaining hardenability.

In addition, Patent Literature 2 discloses a method for manufacturing a medium- or high-carbon steel sheet excellent in terms of local ductility, the method including annealing a hot-rolled steel sheet containing C: 0.10 to 0.60 mass by using heating at a temperature equal to or higher than the Ac1 transformation temperature, in which a metallographic structure (microstructure) having an amount of $\alpha/\gamma$ boundaries per unit area of $\gamma$ of 0.5 $\mu m/\mu m^2$ or more is formed at the end of heating at a temperature equal to or higher than the Ac1 transformation temperature, or in which a metallographic structure having a number of undissolved carbides of one or more per 100 $\mu m^2$ and an amount of $\alpha/\gamma$ boundaries per unit area of $\gamma$ of 0.3 $\mu m/\mu m^2$ or more is formed at the end of heating at a temperature equal to or higher than the Ac1 transformation temperature, and thereafter cooling the heated steel sheet to a temperature equal to or lower than the Ar1 transformation temperature at a cooling rate of 50° C./h or less. The object of the invention according to Patent Literature 2 is to provide a method for manufacturing a medium- or high-carbon steel sheet as a material with which there is a stable increase in stretch flangeability and with which sufficient hardenability is achieved even after being formed into a part by using a common medium- or high-carbon type steel sheet without adding any special chemical element. In addition, in Patent Literature 2, it is said that a chemical element which improves properties such as hardenability may be added and that, in particular, a minute amount of B added significantly increases hardenability of steel material.

In addition, there is a case where a hot-rolled steel sheet which is used as a raw material to be subjected to press forming is required to have an in-plane anisotropy ($\Delta r$) of an r value (Lankford value) of almost 0, that is, a small absolute value for $\Delta r$ in order to achieve satisfactory roundness or in order to prevent a variation in thickness.

CITATION LIST

Patent Literature

PTL 1: Japanese Unexamined Patent Application Publication No. 2006-45679

PTL 2: Japanese Unexamined Patent Application Publication No. 2001-73033

SUMMARY

Technical Problem

In the case of the technique according to Patent Literature 1, it is necessary to perform cold rolling with a low rolling reduction before performing annealing. The object of the technique according to Patent Literature 1 is to significantly decrease hardness after annealing by performing three-step annealing under the specified conditions after performing such cold rolling with a low rolling reduction. However, in the case of this technique, it is necessary to perform involving cold rolling a process with a low rolling reduction, which is not usually performed, before annealing. Therefore, in the case of this technique, there is a problem of an increase in manufacturing costs in comparison with the case where such a process is not performed. In the case of the technique according to Patent Literature 1, it is difficult to sufficiently soften a steel sheet without performing cold rolling with a low rolling reduction on a hot-rolled steel sheet before annealing is performed.

In addition, in the case of the technique according to Patent Literature 2, B is said to be a chemical element which increases hardenability when added in a minute amount. On the other hand, from the results of investigations regarding spheroidizing annealing in a nitrogen atmosphere, which is commonly used as spheroidizing annealing, the present inventors found a problem in that it is not possible to achieve sufficient hardenability even if B is added.

In order to achieve satisfactory cold formability, high-carbon hot-rolled steel sheet is required to have comparatively low hardness and high elongation. For example, some of the high-carbon hot-rolled steel sheets for automotive parts which is applicable integral forming by using cold press instead of plural processes such as hot forging, cutting, and welding to date, are required to have workability of a level corresponding to a hardness of 65 or less in terms of Rockwell hardness HRB and a total elongation of 40% or more. On the other hand, such high-carbon hot-rolled steel sheets excellent in workability are required to have excellent hardenability, for example, a hardness of 440 or more, or even 500 or more, in terms of Vickers hardness (HV) after water quenching has been performed.

An object of disclosed embodiments is, by solving the problems described above, to provide a high-carbon hot-rolled steel sheet whose raw material is a B-containing steel, with which excellent hardenability is stably achieved even if annealing is performed in a nitrogen atmosphere, and which has excellent workability corresponding to a hardness of 65 or less in terms of HRB and a total elongation El of 40% or more before a quenching treatment is performed and to provide a method for manufacturing the steel sheet.

In addition, a further object of disclosed embodiments is to provide a high-carbon hot-rolled steel sheet having a small in-plane anisotropy of an r value of 0.15 or less in terms of the absolute value of Δr.

Solution to Problem

The present inventors diligently conducted investigations regarding the relationship between the conditions for manufacturing a B-containing high-carbon hot-rolled steel sheet and workability and hardenability, and as a result, obtained the following knowledge.

i) The hardness and total elongation (hereinafter, also simply referred to as "elongation") before quenching of a high-carbon hot-rolled steel sheet is strongly influenced by the density of cementite in ferrite grains. By controlling the density of cementite in ferrite grains to be 0.10 pieces/$\mu m^2$ or less, it is possible to achieve excellent workability corresponding to a hardness of 65 or less in terms of HRB and a total elongation (El) of 40% or more.

ii) In the case where annealing is performed in a nitrogen atmosphere, since nitrogen is concentrated in a steel sheet due to nitriding from the atmosphere, nitrogen combines with B in the steel sheet to form BN, which results in a significant decrease in the amount of a solute B in the steel sheet. Here, "nitrogen atmosphere" refers to an atmosphere containing 90 vol % or more of nitrogen. On the other hand, by adding at least one of Sb, Sn, Bi, Ge, Te, and Se to steel in specified amounts, it is possible to prevent nitriding, and it is possible to achieve excellent hardenability by inhibiting a decrease in the amount of a solute B.

Disclosed embodiments have been completed on the basis of the knowledge described above, and the subject matter of the embodiments is as follows.

[1] A high-carbon hot-rolled steel sheet excellent in terms of hardenability and workability, the steel sheet having a chemical composition containing, by mass %, C: 0.20% or more and 0.48% or less, Si: 0.10% or less, Mn: 0.50% or less, P: 0.03% or less, S: 0.010% or less, sol.Al: 0.10% or less, N: 0.0050% or less, B: 0.0005% or more and 0.0050% or less, one or more of Sb, Sn, Bi, Ge, Te, and Se in an amount of 0.002% or more and 0.030% or less in total, and the balance containing Fe and incidental impurities, a microstructure including ferrite and cementite and having a density of cementite in ferrite grains of 0.10 pieces/$\mu m^2$ or less, a hardness of 65 or less in terms of HRB, and a total elongation of 40% or more.

[2] The high-carbon hot-rolled steel sheet excellent in terms of hardenability and workability according to item [1] above, the steel sheet having the chemical composition further containing, by mass %, at least one of Ni, Cr, and Mo in an amount of 0.50% or less in total.

[3] The high-carbon hot-rolled steel sheet excellent in terms of hardenability and workability according to item [1] or [2] above, in which the absolute value of the in-plane anisotropy (Δr) of an r value is 0.15 or less.

[4] A method for manufacturing a high-carbon hot-rolled steel sheet excellent in terms of hardenability and workability, the method including performing hot rough rolling on steel having the chemical composition according to item [1] or [2] above, thereafter performing finish rolling with a finishing temperature equal to or higher than the Ar3 transformation temperature, coiling the hot-rolled steel sheet at a coiling temperature of 500° C. or higher and 750° C. or lower, thereafter heating and holding the coiled steel sheet at a temperature equal to or higher than the Ac1 transformation temperature for holding time of 0.5 hours or more, cooling the heated steel sheet to a temperature lower than the Ar1 transformation temperature at a cooling rate of 1° C./h or more and 20° C./h or less, and holding the steel sheet at a temperature lower than the Ar1 transformation temperature for 20 hours or more.

[5] The method for manufacturing a high-carbon hot-rolled steel sheet excellent in terms of hardenability and workability according to item [4] above, in which the finishing temperature is 900° C. or higher.

Advantageous Effects

According to embodiments, it is possible to manufacture a high-carbon hot-rolled steel sheet excellent in terms of hardenability and cold formability (workability). The high-carbon hot-rolled steel sheet according to embodiments can preferably be used for automotive parts such as gears, transmissions, seat recliners, and hubs, whose raw material steel sheets are required to have satisfactory cold formability.

DETAILED DESCRIPTION

A high-carbon hot-rolled steel sheet and a method for manufacturing the steel sheet according to embodiments will be described in detail hereafter. Here, "%" used when describing the percentage of each amount of a chemical composition represents "mass %", unless otherwise noted.

1) Chemical Composition

C: 0.20% or More and 0.48% or Less

C is a chemical element which is important for achieving satisfactory strength after quenching has been performed. In the case where the C content is less than 0.20%, it is not possible to achieve desired hardness by performing a heat treatment after a steel sheet has been formed into a part. Therefore, it is necessary that the C content be 0.20% or more. On the other hand, in the case where the C content is more than 0.48%, there is a decrease in toughness and cold formability due to an increase in the hardness of a steel sheet. Therefore, it is necessary that the C content be 0.48% or less, or preferably 0.40% or less. Therefore, the C content is set to be 0.20% or more and 0.48% or less. It is preferable that the C content be 0.26% or more in order to achieve excellent quenching hardness. Moreover, it is preferable that the C content be 0.32% or more in order to stably achieve a hardness of 500 or more in terms of Vickers hardness (HV) after water quenching has been performed.

Si: 0.10% or Less

Si is a chemical element which increases strength through solid solution strengthening. Since the hardness of a steel sheet increases and cold formability decreases with increasing Si content, the Si content is set to be 0.10% or less, or preferably 0.05% or less. Although it is preferable that the Si content be as small as possible since Si decreases cold formability, since there is an increase in refining costs in the case where the Si content is excessively low, it is preferable that the Si content be 0.005% or more.

Mn: 0.50% or Less

Mn is a chemical element which increases hardenability and which increases strength through solid solution strengthening. In the case where the Mn content is more than 0.50%, since a band structure grows due to the segregation of Mn, the steel microstructure becomes non-uniform, which results in a decrease in cold formability. Therefore, the Mn content is set to be 0.50% or less. Here, there is no particular limitation on the lower limit of the Mn content. It is preferable that the Mn content be 0.20% or more in order to achieve specified quenching hardness by dissolving all C in a steel sheet as a result of inhibiting the precipitation of graphite when a solution heat treatment is performed for quenching.

P: 0.03% or Less

P is a chemical element which increases strength through solid solution strengthening. In the case where the P content is more than 0.03%, since grain boundary embrittlement occurs, there is a decrease in toughness after quenching has been performed. Therefore, the P content is set to be 0.03% or less. It is preferable that the P content be 0.02% or less in order to achieve excellent toughness after quenching has been performed. Since P decreases cold formability and after-quenching toughness, it is preferable that the P content be as small as possible. On the other hand, since there is an increase in refining costs in the case where the P content is excessively low, it is preferable that the P content be 0.005% or more.

S: 0.010% or Less

S is a chemical element whose content must be decreased, because S decreases the cold formability and after-quenching toughness of a high-carbon hot-rolled steel sheet as a result of forming sulfides. In the case where the S content is more than 0.010%, there is a significant decrease in the cold formability and after-quenching toughness of a high-carbon hot-rolled steel sheet. Therefore, the S content is set to be 0.010% or less. It is preferable that the S content be 0.005% or less in order to achieve excellent cold formability and after-quenching toughness. Since S decreases cold formability and after-quenching toughness, it is preferable that the S content be as small as possible. On the other hand, since there is an increase in refining costs in the case where the S content is excessively low, it is preferable that the S content be 0.0005% or more.

Sol.Al: 0.10% or Less

In the case where the sol.Al (acid-soluble aluminum) content is more than 0.10%, since the austenite grain diameter becomes excessively small due to the formation of AlN when heating is performed for a quenching treatment, the steel microstructure is composed of ferrite and martensite because the formation of a ferrite phase is promoted when cooling is performed for a quenching treatment, which results in a decrease in hardness after quenching has been performed and results in a decrease in toughness after quenching has been performed. Therefore, the sol.Al content is set to be 0.10% or less, or preferably 0.06% or less. Here, since sol.Al is effective for deoxidation, it is preferable that the sol.Al content be 0.005% or more in order to realize sufficient deoxidation.

N: 0.0050% or Less

In the case where the N content is more than 0.0050%, there is a decrease in the amount of a solute B as a result of forming BN. In addition, in the case where the N content is more than 0.0050%, since the austenite grain diameter becomes excessively small due to the formation of BN and AlN when heating is performed for a quenching treatment, the formation of ferrite phase is promoted when cooling is performed for a quenching treatment, which results in a decrease in hardness after quenching has been performed and results in a decrease in toughness after quenching has been performed. Therefore, the N content is set to be 0.0050% or less. There is no particular limitation on the lower limit of the N content. Here, as described above, since N is a chemical element which increases toughness after quenching has been performed by appropriately inhibiting austenite grain growth when heating is performed for a quenching treatment as a result of forming BN and AlN, it is preferable that the N content be 0.0005% or more.

B: 0.0005% or More and 0.0050% or Less

B is a chemical element which is important for increasing hardenability. Since a sufficient effect is not realized in the case where the B content is less than 0.0005%, it is necessary that the B content be 0.0005% or more, or preferably 0.0009% or more. On the other hand, in the case where the B content is more than 0.0050%, since austenite recrystallization is delayed after finish rolling has been performed, the texture of a hot-rolled steel sheet grows, which results in an increase in the anisotropy of the steel sheet after annealing has been performed. Therefore, it is necessary that the B content be 0.0050% or less, or preferably 0.0035% or less. Therefore the B content is set to be 0.0005% or more and 0.0050% or less.

One or More of Sb, Sn, Bi, Ge, Te, and Se in an Amount of 0.002% or More and 0.030% or Less in Total Sb, Sn, Bi, Ge, Te, and Se are chemical elements which are important for inhibiting nitriding through the surface layer. In the case where the sum of the contents of these chemical elements is less than 0.002%, a sufficient effect is not realized. Therefore, one or more of Sb, Sn, Bi, Ge, Te, and Se are added, and the lower limit of the sum of the contents of these chemical elements is set to be 0.002%. Preferably the lower limit of the sum of the contents of these chemical elements is set to be 0.005%. On the other hand, in the case where the sum of the contents of these chemical elements is more than 0.030%, the effect of preventing nitriding becomes saturated. In addition, since these chemical elements tend to segregate at grain boundaries, grain boundary embrittlement may occur due to excessive contents in the case where the sum of the contents of these chemical elements is more than 0.030%. Therefore, the upper limit of the sum of the contents of Sb, Sn, Bi, Ge, Te, and Se is set to be 0.030%. Preferably, the sum of the contents of Sb, Sn, Bi, Ge, Te, and Se is set to be 0.020% or less. Therefore, one or more of Sb, Sn, Bi, Ge, Te, and Se are added, and the sum of the contents of these chemical elements is set to be 0.002% or more and 0.030% or less, or preferably 0.005% or more and 0.020% or less.

In embodiments, as described above, one or more of Sb, Sn, Bi, Ge, Te, and Se are added in an amount of 0.002% or more and 0.030% or less in total. With this method, since nitriding through the surface layer of a steel sheet is inhibited even in the case where annealing is performed in a nitrogen atmosphere, an increase in nitrogen concentration in the surface layer of a steel sheet is inhibited. Therefore, it is possible to control the difference between the N content in the region within the depth of 150 μm in the thickness direction from the surface layer of the steel sheet and the average N content of the whole steel sheet to be 30 mass ppm or less. In addition, since nitriding is inhibited, it is possible to achieve a sufficient amount of solute B in a steel sheet after annealing has been performed even if annealing has been performed in a nitrogen atmosphere. Therefore, since it is possible to control the ratio of the amount of a solute B in a steel sheet to the amount of B added {(the amount of a solute B)/(the amount B added)}×100(%) to be 75(%) or more, it is possible to achieve high hardenability. Here, "the amount of B added" refers to the B content in a steel.

Although the balance of the chemical composition is Fe and incidental impurities, at least one of Ni, Cr, and Mo may be added in an amount of 0.50% or less in total in order to further increase hardenability. That is to say, at least one of Ni, Cr, and Mo may be added, and the sum of the contents of Ni, Cr, and Mo may be 0.50% or less. Here, since Ni, Cr, and Mo are expensive, it is preferable that the sum of the contents be 0.20% or less in total in order to prevent an increase in cost. In order to realize the effect described above, it is preferable that the sum of the contents of Ni, Cr, and Mo be 0.01% or more.

2) Microstructure

In the case where the density of cementite in ferrite grains is high, since there is an increase in hardness due to dispersion strengthening, there is a decrease in elongation. In embodiments, by controlling the density of cementite in ferrite grains to be 0.10 pieces/$\mu m^2$ or less, it is possible to achieve a hardness of 65 or less in terms of Rockwell hardness HRB and a total elongation of 40% or more. Therefore, the microstructure of the steel sheet according to embodiments is a microstructure including ferrite and cementite in which the density of cementite in ferrite grains is 0.10 pieces/$\mu m^2$ or less, preferably 0.06 pieces/$\mu m^2$ or less, or more preferably less than 0.04 pieces/$\mu m^2$. The density of cementite in ferrite grains may be 0 pieces/$\mu m^2$. Here, the major axis of a cementite grain existing in ferrite grains is about 0.15 to 1.8 μm, which is the size effective for the precipitation strengthening of a steel sheet. Therefore, in the steel sheet according to embodiments, it is possible to decrease strength by decreasing the density of cementite in ferrite grains. Since cementite at ferrite grain boundaries scarcely contributes to dispersion strengthening on the other hand, the density of cementite in ferrite grains is set to be 0.10 pieces/$\mu m^2$ or less.

Here, the volume ratio of cementite is about 2.5% or more and 7.0% or less. In addition, even in the case where remaining structures such as pearlite other than ferrite and cementite described above are inevitably formed, if the sum of the volume ratios of the remaining structures is about 5% or less, the effect of disclosed embodiments is not diminished. Therefore, the remaining structures such as pearlite may be included as long as the sum of the volume ratios of the remaining structures is 5% or less in total.

3) Mechanical Properties

In embodiments, since automotive parts such as gears, transmissions, and seat recliners are formed by performing cold press forming, excellent workability is required. In addition, it is necessary to achieve wear resistance by increasing hardness by performing a quenching treatment. Therefore, in the case of the high-carbon hot-rolled steel sheet according to embodiments, the hardness of the steel sheet is decreased to 65 or less in terms of HRB, and the elongation of the steel sheet is increased to an El of 40% or more so as to have excellent workability, and in addition, since it is necessary to increase hardenability, the steel sheet has excellent hardenability.

Here, a quenching treatment such as a water quenching treatment or an oil quenching treatment is performed. A water quenching treatment is a treatment in which, for example, a steel sheet is heated at a temperature of about 850° C. to 1050° C., then held for about 0.1 to 600 seconds, and immediately cooled with water. In addition, an oil quenching treatment is a treatment in which, for example, a steel sheet is heated at a temperature of about 800° C. to 1050° C., then held for about 60 to 3600 seconds, and immediately cooled with oil. "Excellent hardenability" refers to a case where a hardness of 440 or more, or preferably 500 or more, in terms of Vickers hardness (HV) is achieved by performing a water quenching treatment in which, for example, a steel sheet is held at a temperature of 870° C. for 30 seconds and then immediately cooled with water. In addition, a microstructure after a water quenching treatment or an oil quenching treatment has been performed is a martensite single-phase structure or a mixed structure composed of a martensite phase and a bainite phase.

4) Manufacturing Conditions

The high-carbon hot-rolled steel sheet according to embodiments is manufactured by using steel as a raw material, having the chemical composition described above, by performing hot rough rolling, by then performing finish rolling with a finishing temperature equal to or higher than the Ar3 transformation temperature, by coiling the hot-rolled steel sheet at a coiling temperature of 500° C. or higher and 750° C. or lower, by then heating and holding the coiled steel sheet at a temperature equal to or higher than the Ac1 transformation temperature for holding time of 0.5 hours or more, by cooling the heated steel sheet to a temperature lower than the Ar1 transformation temperature at a cooling rate of 1° C./h or more and 20° C./h or less, and then holding the cooled steel sheet at a temperature lower than the Ar1 transformation temperature for 20 hours or more.

Hereafter, the reasons for limitations on the method for manufacturing the high-carbon hot-rolled steel sheet according to embodiments will be described.

Finishing Temperature: Equal to or Higher than the Ar3 Transformation Temperature In the case where the finishing temperature is lower than the Ar3 transformation temperature, since ferrite grains having a large diameter are formed after hot rolling have been performed and after annealing have been performed, there is a significant decrease in elongation. Therefore, the finishing temperature is set to be equal to or higher than the Ar3 transformation temperature. Here, although there is no particular limitation on the upper limit of the finishing temperature, it is preferable that the finishing temperature be 1000° C. or lower in order to smoothly perform cooling after finish rolling has been performed.

Coiling Temperature: 500° C. or Higher and 750° C. or Lower

A hot-rolled steel sheet after finish rolling has been performed is wound in a coil shape. It is not preferable from the viewpoint of operational efficiency that the coiling temperature be excessively high, because, since the strength of the hot-rolled steel sheet becomes excessively low, there is a case where the coil shape is deformed due to its own weight when the steel sheet is wound in a coil shape. Therefore, the upper limit of the coiling temperature is set to be 750° C. On the other hand, it is not preferable that the coiling temperature be excessively low, because there is an increase in the hardness of the hot-rolled steel sheet. Therefore, the lower limit of the coiling temperature is set to be 500° C.

Two-step annealing including heating and holding the coiled steel sheet at a temperature equal to or higher than the Ac1 transformation temperature for holding time of 0.5 hours or more (first annealing), cooling the heated steel sheet to a temperature lower than the Ar1 transformation temperature at a cooling rate of 1° C./h or more and 20° C./h or less, and holding the steel sheet at a temperature lower than the Ar1 transformation temperature for 20 hours or more (second annealing)

In embodiments, by heating and holding a hot-rolled steel sheet at a temperature equal to or higher than the Ac1 transformation temperature for heating time of 0.5 hours or more, carbides having a comparatively small diameter which have been precipitated in the hot-rolled steel sheet are dissolved in order to form a solid solution in a γ phase. Then, by cooling the heated steel sheet to a temperature lower than the Ar1 transformation temperature at a cooling rate of 1° C./h or more and 20° C./h or less, and holding the steel sheet at a temperature lower than the Ar1 transformation temperature for 20 hours or more, a solute C is precipitated by using, for example, undissolved carbides having a comparatively large diameter as nucleation sites. With this method, the density of cementite in ferrite grains is controlled to be 0.10 pieces/$\mu m^2$ or less that is, the dispersion of carbides (cementite) is put under control. Therefore, in disclosed embodiments, by performing two-step annealing under the specified conditions, the dispersion state of carbides is controlled so that a steel sheet is softened. In the case of the high-carbon steel sheet for which disclosed embodiments are intended, it is important to control the dispersion morphology of carbides after annealing has been performed in order to soften the steel sheet. In embodiments, by heating and holding a high-carbon hot-rolled steel sheet at a temperature equal to or higher than the Ac1 transformation temperature (first annealing), carbides having a small diameter are dissolved, and C is solved in γ (austenite). Subsequently, in the cooling and holding stage at a temperature lower than the Ar1 transformation temperature (second annealing), carbides having a comparatively large diameter are precipitated by using α/γ boundaries and undissolved carbides, which exist when the temperature is equal to or higher than the Ac1 transformation temperature, as nucleation sites. Hereafter, the conditions of such two-step annealing will be described. Here, as an atmospheric gas when annealing is performed, any one of nitrogen, hydrogen, or a mixture gas of nitrogen and hydrogen may be used. In addition, although any one of the gases described above may be used as an atmospheric gas when annealing is performed, it is preferable from the viewpoint of cost and safety that a gas containing 90 vol % or more of nitrogen be used.

Heating and Holding at a Temperature Equal to or Higher than the Ac1 Transformation Temperature for Holding Time of 0.5 Hours or More (First Annealing)

By heating a hot-rolled steel sheet at an annealing temperature equal to or higher than the Ac1 transformation temperature, a part of ferrite in microstructure of a steel sheet is transformed into austenite, fine carbides which have been precipitated in ferrite are dissolved, and C is solved in austenite. On the other hand, since ferrite which has been left without transforming into austenite is subjected to annealing at a high temperature, there is a decrease in hardness due to a decrease in dislocation density. In addition, carbides (undissolved carbides) having a comparatively large diameter which have not been dissolved in ferrite are retained, and there is a further increase in the diameter of such carbides due to Ostwald growth. In the case where the annealing temperature is lower than the Ac1 transformation temperature, since austenite transformation does not occur, it is not possible to dissolve carbides into austenite. In addition, in embodiments, in the case where the holding time at a temperature equal to or higher than the Ac1 transformation temperature is less than 0.5 hours, it is not possible to dissolve a sufficient amount of fine carbides. Therefore, in the first annealing, a steel sheet is heated and held at a temperature of equal to or higher than the Ac1 transformation temperature for 0.5 hours or more, or preferably at a temperature equal to or higher than (the Ac1 transformation temperature +10°) C. and/or for holding time of 1.0 hour or more. Here, although there is no particular limitation, it is preferable that the annealing temperature be 800° C. or lower and the holding time be 10 hours or less.

Cooling to a temperature lower than the Ar1 transformation temperature at a cooling rate of 1° C./h or more and 20° C./h or less After the first annealing described above has been performed, the annealed steel sheet is cooled to a temperature lower than the Ar1 transformation temperature, which is the temperature range for the second annealing, at a cooling rate of 1° C./h or more and 20° C./h or less. During the cooling, while austenite to ferrite transformation occurs, C (carbon) is transferred out of austenite. Such C, which has been transferred out of austenite, is precipitated in the form of a spherical carbide having a comparatively large diameter by using α/γ boundaries and undissolved carbides as nucleation sites. In this cooling, it is necessary to control a cooling rate so that pearlite is not formed. Since production efficiency is unsatisfactory in the case where the cooling rate after the first annealing has been performed and before the second annealing is performed is less than 1° C./h, the cooling rate is set to be 1° C./h or more, or preferably 5° C./h or more. On the other hand, since there is an increase in hardness due to the precipitation of pearlite in the case where the cooling rate is more than 20° C./h, the cooling rate is set to be 20° C./h or less. Preferably, the cooling rate is set to be 15° C./h or less. Therefore the cooling is performed at a cooling rate of 1° C./h or more and 20° C./h or less, after the first annealing has been performed, down to the temperature range of the second annealing that is performed at a temperature equal to or lower than the Ar1 transformation temperature. It is preferable that the cooling be performed down to a temperature lower than the Ar1 transformation temperature and equal to or higher than 660° C. which is a preferable temperature range for the second annealing.

Holding at a Temperature Lower than the Ar1 Transformation Temperature for 20 Hours or More (Second Annealing)

After the first annealing described above has been performed, by cooling the steel sheet at the specified cooling rate, and by holding the steel sheet at a temperature lower than the Ar1 transformation temperature, fine carbides are eliminated as a result of the further growth of spherical carbides having a large diameter due to Ostwald growth. In the case where the holding time at a temperature lower than the Ar1 transformation temperature is less than 20 hours, it is not possible to sufficiently grow carbides, there is an excessive increase in hardness after annealing has been performed. Therefore, in the second annealing, the steel sheet is held at a temperature lower than the Ar1 transformation temperature for 20 hours or more, preferably at a temperature of 720° C. or lower, and preferably the holding time be for 22 hours or more. Here, although there is no limitation, it is preferable that the second annealing temperature be 660° C. or higher in order to sufficiently grow carbides and that the holding time be 30 hours or less from the viewpoint of production efficiency.

Here, in order to prepare the molten high-carbon steel according to embodiments, any one of a converter and an electric furnace may be used. In addition, the molten high-carbon steel which has been prepared in such a way is made into a slab by using an ingot casting-blooming method or a continuous casting method. The slab is usually hot-rolled after having been heated. Here, a slab which has been manufactured by using a continuous casting method may be subjected to direct rolling in the as-cast state or after heat-retention has been performed in order to inhibit a decrease in temperature. In addition, in the case where hot rolling is performed after the slab has been heated, it is preferable that the slab heating temperature be 1280° C. or lower in order to avoid a deteriorate in surface quality due to scale. In hot rolling, in order to ensure a finishing temperature, the material to be rolled may be heated during hot rolling by using heating means such as a sheet bar heater.

Further, in embodiments, it is preferable that the finishing temperature of hot rolling described above be 900° C. or higher in order to decrease anisotropy after annealing has been performed. In the case where the finishing temperature is lower than 900° C., since a rolled microstructure (untransformed structure) tends to be retained, there may be an increase in the in-plane anisotropy of an r value after annealing has been performed. By controlling the finishing temperature to be 900° C. or higher, it is possible to control the in-plane anisotropy of the r value of a hot-rolled steel sheet after annealing has been performed to be 0.15 or less in terms of absolute value, that is, it is possible to control Δr to be near to 0. Therefore, it is preferable that the finishing temperature be 900° C. or higher in order to decrease the in-plane anisotropy of an r value. Moreover, it is preferable that the finishing temperature be 950° C. or higher in order to control the in-plane anisotropy of an r value to be 0.10 or less in terms of absolute value.

EXAMPLE 1

Molten steels having the chemical compositions of steel codes A through H given in Table 1 were prepared and cast. Subsequently, hot rolling was performed with a finishing temperature equal to or higher than the Ar3 transformation temperature under the manufacturing conditions given in Table 2, and them pickling was performed. Subsequently, spheroidizing annealing was performed by using two-step annealing in a nitrogen atmosphere (atmosphere gas: a mix gas containing 95 vol % of nitrogen and the balance being hydrogen), hot rolled and annealed steel sheets having a thickness of 4.0 mm were manufactured. The manufactured hot rolled and annealed steel sheets were investigated as described below in terms of microstructure, hardness, elongation, quenching hardness, and the in-plane anisotropy (Δr) of an r value. In addition, the difference between nitrogen content in the surface layer within the depth of 150 μm and average N content in the steel sheet is determined and also (the amount of a solute B)/(the amount B added) is determined. Here, the Ar1 transformation temperature, the Ac1 transformation temperature, and the Ar3 transformation temperature given in Table 1 were derived from a thermal expansion curve.

Hardness of a Steel Sheet after Annealing Had been Performed

A sample was taken from the central portion in the width direction of the steel sheet (original sheet) after annealing has been performed, hardness was measured at 5 points by using a Rockwell hardness meter (B scale), and then the average value of the measured values were determined.

Elongation of a Steel Sheet after Annealing Had been Performed

A tensile test was performed on a JIS No. 5 tensile test piece which was cut out of the steel sheet (original sheet) after annealing has been performed in the direction at an angle of 0° to the rolling direction (L direction) by using a tensile testing machine AG10TB AG/XR manufactured by SHIMADZU CORPORATION at a testing speed of 10 mm/min, and then elongation was determined by butting the broken test piece.

Microstructure

In order to investigate the microstructure of the steel sheet after annealing had been performed, a sample which had been taken from the central portion in the width direction was cut, the cut surface (thickness cross section parallel to the rolling direction) was polished and then etched by using a nital, and then microstructure photographs were taken at 5 places in the central portion in the thickness direction by using a scanning electron microscope at a magnification of 3000 times. By observing the microstructure photographs, the number of cementite grains having a major axis of 0.15 μm or more which were not present at grain boundaries was measured, and a cementite density in grains were determined by dividing the number by the area of the field of view of the photograph.

In-plane Anisotropy of an r Value (Δr)

A tensile strain was applied to JIS No. 5 test pieces which were cut out of the steel sheet (original sheet) after annealing had been performed respectively in the directions at angles of 0°, 45°, and 90° to the rolling direction by using a tensile testing machine AG10TB AG/XR manufactured by SHIMADZU CORPORATION at a testing speed of 10 mm/min so that a strain of 12% is given to the test pieces, an r value for each direction was determined by using equation (1) below, and Δr was derived by using equation (2) below.

$$r=\ln(w/w0)/\ln(t/t0) \quad (1),$$

where w: the width of a test piece to which a strain of 12% had been given, w0: the width of a test piece before the strain was applied, t: the thickness of a test piece to which a strain of 12% had been given, and t0: the thickness of a test piece before the strain was applied.

$$\Delta r=(r0+r90-2r45)/2 \quad (2),$$

where r0, r45, and r90 respectively represent the r values for the test pieces taken in the directions at angles of 0°, 45°, and 90° to the rolling direction.

Difference between nitrogen content in the surface layer within the depth of 150 μm and average N content in the steel sheet The nitrogen content in the surface layer within the depth of 150 μm and average N content in the steel sheet of a sample taken from the central portion in the width direction of the steel sheet after annealing had been performed were measured, and the difference between nitrogen content in the surface layer within the depth of 150 μm and average N content in the steel sheet was determined. Here, "nitrogen content in the surface layer within the depth of 150 μm" refers to the nitrogen content in the region within the depth of 150 μm in the thickness direction from the surface of the steel sheet. In addition, nitrogen content in the surface layer within the depth of 150 μm was determined as described below. Cutting was started from the surface of the taken steel sheet and ended at the depth of 150 μm from the surface, and the chips by cutting which were generated during the cutting were taken as samples. The N content in the samples was determined, and the nitrogen content in the surface layer within the depth of 150 μm was defined as the N content in the samples. The nitrogen content in the surface layer within the depth of 150 μm and the average N content in the steel sheet were obtained by determining each N content by using an inert gas transportation fusion-thermal conductivity method. A case where the difference between nitrogen content in the surface layer within the depth of 150 μm (the nitrogen content in the region within the depth of 150 μm in the thickness direction from the surface of the steel sheet) and average N content in the steel sheet (N content in steel) which was derived as described above was 30 mass ppm or less can be judged as a case where nitriding was inhibited.

The Amount of a Solute B)/(the Amount B Added

BN in a sample which had been taken from the central portion in the width direction of the steel sheet after annealing had been performed was extracted by using a 10 (vol %) Br-methanol, the content of B which forms BN in the steel was determined, and then the amount of a solute B was derived by subtracting the content of B which forms BN from the total amount of B added. And then, the ratio of the amount of a solute B, which was derived as described above, to the amount of B added (B content), that is, (the amount of a solute B)/(the amount B added) was derived. A case where {(the amount of a solute B)(mass %)/(the amount B added) (mass %)}×100(%) was 75(%) or more can be judged as a case where the decrease in the amount of a solute B was inhibited.

Hardness of a Steel Sheet after Quenching Had been Performed (Quenching Hardness)

A quenching treatments were performed on a flat test piece (having a width of 15 mm, a length of 40 mm, and a thickness of 4 mm) which had been taken from the central portion of the steel sheet in the width direction after annealing had been performed by respectively using a water cooling method and a 120° C.-oil cooling method as described below in order to determine the hardness of the steel sheet after quenching had been performed (quenching hardness) for each method. That is to say, quenching treatment was performed on the flat test piece described above by using each of a method in which the test piece was held at a temperature of 870° C. for 30 seconds and then immediately cooled with water (water cooling) and a method in which the test piece was held at a temperature of 870° C. for 30 seconds and then immediately cooled with oil having a temperature of 120° C. (120° C.-oil cooling). As for hardenability, quenching hardness was defined as the average value of the hardness values for 5 points which were determined by using a Vickers hardness testing machine with a load of 1 kgf in the cut surface of the test piece after quenching has been performed. A case where both hardness values after water cooling and 120° C.-oil cooling respectively had been performed satisfied the conditions given in Table 3 was judged that quenching hardness is satisfactory (O) and the hardenability is excellent. In addition, a case where at least one of the hardness values after water cooling and 120° C.-oil cooling respectively had been performed did not satisfy the conditions given in Table 3 was judged as unsatisfactory (x) and as a case of poor hardenability. Here, Table 3 shows the values of quenching hardness in accordance with the contents of C with which the hardenability of a steel sheet can be judged as satisfactory from experience.

From the results given in Table 2, it is clarified that the hot-rolled steel sheets of the examples of disclosed embodiments had a microstructure composed of ferrite and cementite having a cementite density in ferrite grains of 0.10 pieces/$\mu m^2$ or less. In addition, it is clarified that the hot-rolled steel sheet of the examples of disclosed embodiments had a hardness of 65 or less in terms of HRB and a total elongation of 40% or more, which means that these steel sheets were excellent in terms of cold formability and hardenability. In addition, the hot-rolled steel sheets of the examples of disclosed embodiments which was manufactured with a finishing temperature of 900° C. or higher had a Δr of −0.14 to −0.07, that is, easily satisfied the condition that the absolute value of Δr is 0.15 or less, which means that anisotropy is small as indicated by the value of Δr near to 0.

TABLE 1

| Steel | Chemical Composition (mass %) | | | | | | | | | |
|---|---|---|---|---|---|---|---|---|---|---|
| Code | C | Si | Mn | P | S | sol. Al | N | B | Sb, Sn, Bi, Ge, Te, Se | Other |
| A | 0.35 | 0.01 | 0.34 | 0.01 | 0.003 | 0.04 | 0.0033 | 0.0030 | Sb: 0.010 | — |
| B | 0.35 | 0.01 | 0.34 | 0.01 | 0.003 | 0.04 | 0.0041 | 0.0030 | Sb + Bi: 0.020 | — |
| C | 0.35 | 0.01 | 0.34 | 0.01 | 0.003 | 0.04 | 0.0033 | 0.0015 | Sb: 0.010 | — |
| D | 0.20 | 0.02 | 0.30 | 0.02 | 0.010 | 0.03 | 0.0033 | 0.0025 | Sb + Sn: 0.020 | Ni : 0.02 |
| E | 0.35 | 0.01 | 0.45 | 0.01 | 0.003 | 0.04 | 0.0033 | 0.0030 | Sb + Ge + Te + Se: 0.010 | — |
| F | 0.40 | 0.02 | 0.35 | 0.02 | 0.010 | 0.03 | 0.0033 | 0.0020 | Sb + Sn: 0.015 | Cr: 0.12 |
| G | 0.48 | 0.01 | 0.34 | 0.01 | 0.003 | 0.04 | 0.0033 | 0.0015 | Sb: 0.010 | Mo: 0.02 |
| H | 0.35 | 0.02 | 0.35 | 0.01 | 0.003 | 0.04 | 0.0033 | 0.0030 | Sb + Sn + Bi + Ge + Te + Se: 0.001 | — |

| Steel Code | Ac1 Transformation Temperature (° C.) | Ar1 Transformation Temperature (° C.) | Ar3 Transformation Temperature (° C.) | Note |
|---|---|---|---|---|
| A | 722 | 706 | 803 | Within Scope of Embodiments |
| B | 722 | 706 | 803 | Within Scope of Embodiments |
| C | 722 | 706 | 803 | Within Scope of Embodiments |
| D | 725 | 768 | 836 | Within Scope of Embodiments |

TABLE 1-continued

| | | | | | |
|---|---|---|---|---|---|
| | E | 719 | 699 | 800 | Within Scope of Embodiments |
| | F | 723 | 686 | 796 | Within Scope of Embodiments |
| | G | 716 | 655 | 782 | Within Scope of Embodiments |
| | H | 723 | 706 | 803 | Outside Scope of Embodiments |

TABLE 2

| | | Hot Rolling Condition | | Annealing Condition | | | | Density | | |
|---|---|---|---|---|---|---|---|---|---|---|
| Sample Number | Steel Code | Finishing Temperature (° C.) | Coiling Temperature (° C.) | First Annealing (Annealing Temperature-Holding Time) | Cooling Rate from First Annealing to Second Annealing (° C./h) | Second Annealing (Annealing Temperature-Holding Time) | Microstructure | of Cementite in Fenite Grain (pieces/μm²) | Hardness of Original Sheet (HRB) | Elongation of Original Sheet (%) |
| 1 | A | 930 | 600 | 750° C.-1 h | 10 | 700° C.-22 h | Ferrite-Cementite | 0.02 | 62 | 43 |
| 2 | A | 850 | 600 | 750° C.-1 h | 10 | 700° C.-22 h | Ferrite-Cementite | 0.01 | 60 | 44 |
| 3 | B | 960 | 650 | 750° C.-1 h | 10 | 700° C.-22 h | Ferrite-Cementite | 0.02 | 62 | 43 |
| 4 | B | 960 | 650 | 710° C.-30 h | — | — | Ferrite-Cementite | 0.18 | 72 | 37 |
| 5 | C | 930 | 550 | 750° C.-1 h | 10 | 700° C.-22 h | Ferrite-Cementite | 0.02 | 61 | 43 |
| 6 | D | 920 | 600 | 770° C.-1 h | 10 | 750° C.-22 h | Ferrite-Cementite | 0.01 | 57 | 45 |
| 7 | E | 970 | 600 | 750° C-1 h | 10 | 690° C.-22 h | Ferrite-Cementite | 0.02 | 62 | 43 |
| 8 | E | 970 | 600 | 750° C-0.3 h | 10 | 690° C.-22 h | Ferrite-Cementite | 0.17 | 73 | 37 |
| 9 | F | 930 | 600 | 750° C-1 h | 10 | 680° C.-22 h | Ferrite-Cementite | 0.03 | 63 | 41 |
| 10 | G | 850 | 600 | 750° C.-1 h | 10 | 640° C.-22 h | Ferrite-Cementite | 0.03 | 65 | 40 |
| 11 | H | 930 | 600 | 750° C.-1 h | 10 | 700° C.-22 h | Ferrite-Cementite | 0.03 | 63 | 42 |

| Sample Number | $\Delta^r$ | Difference Between N Content in the Surface Layer within 150-m and Average N Content in the Whole Steel Sheet (mass ppm) | Amount of Solute B (mass %) | Amount of Solute B/Amount of B Added × 100 (%) | Quenching Hardness (HV) Water Cooling | Quenching Hardness (HV) 120° C.-Oil Cooling | Hardenability Judgement | Note |
|---|---|---|---|---|---|---|---|---|
| 1 | −0.13 | 20 | 0.0025 | 83 | 605 | 557 | ○ | Example |
| 2 | −0.25 | 20 | 0.0025 | 83 | 605 | 557 | ○ | Example |
| 3 | −0.07 | 10 | 0.0025 | 83 | 610 | 563 | ○ | Example |
| 4 | −0.06 | 10 | 0.0025 | 83 | 630 | 573 | ○ | Comparative Example |
| 5 | −0.12 | 20 | 0.0013 | 87 | 605 | 541 | ○ | Example |
| 6 | −0.14 | 10 | 0.002 | 80 | 450 | 410 | ○ | Example |
| 7 | −0.07 | 10 | 0.0025 | 83 | 610 | 550 | ○ | Example |
| 8 | −0.07 | 10 | 0.0025 | 83 | 630 | 570 | ○ | Comparative Example |
| 9 | −0.13 | 20 | 0.0018 | 90 | 650 | 570 | ○ | Example |
| 10 | −0.28 | 20 | 0.0013 | 87 | 680 | 605 | ○ | Example |
| 11 | −0.14 | 200 | 0.0004 | 13 | 602 | 370 | x | Comparative Example |

TABLE 3

| C content (mass %) | Hardness after Water Cooling (HV) | Hardness after 120° C.-Oil Cooling (HV) |
|---|---|---|
| 0.20 or more and less than 0.35 | ≥440 | ≥360 |
| 0.35 or more and less than 0.40 | ≥600 | ≥530 |
| 0.40 or more and less than 0.48 | ≥620 | ≥550 |
| 0.48 | ≥670 | ≥600 |

The invention claimed is:

1. A high-carbon hot-rolled steel sheet, the steel sheet having a chemical composition comprising:

C: 0.20% or more and 0.48% or less, by mass %;
Si: 0.10% or less, by mass %;
Mn: 0.50% or less, by mass %;
P: 0.03% or less, by mass %;
S: 0.010% or less, by mass %;
acid-soluble Al: 0.10% or less, by mass %;
N: 0.0050% or less, by mass %;
B: 0.0005% or more and 0.0050% or less, by mass %;
one or more elements selected from Sb, Sn, Bi, Ge, Te, and Se such that the total content of the one or more elements is in the range of 0.002% or more and 0.030% or less, by mass %; and
Fe and incidental impurities,
wherein the high-carbon hot-rolled steel sheet has (i) a microstructure including ferrite and cementite, a density of the cementite in the ferrite grains being in the range of 0.10 pieces/$\mu m^2$ or less, (ii) a hardness in the range of 65 or less in terms of HRB, and (iii) a total elongation in the range of 40% or more, and
an absolute value of an in-plane anisotropy ($\Delta r$) of an r value is in the range of 0.15 or less.

2. The high-carbon hot-rolled steel sheet according to claim 1, the chemical composition further comprising at least one element selected from Ni, Cr, and Mo such that the total content of the at least one element is in the range of 0.50% or less, by mass %.

3. A method for manufacturing a high-carbon hot-rolled steel sheet, the method comprising:

performing hot rough rolling on a steel having a chemical composition comprising:
C: 0.20% or more and 0.48% or less, by mass %;
Si: 0.10% or less, by mass %;
Mn: 0.50% or less, by mass %;
P: 0.03% or less, by mass %;
S: 0.010% or less, by mass %;
acid-soluble Al: 0.10% or less, by mass %;
N: 0.0050% or less, by mass %;
B: 0.0005% or more and 0.0050% or less, by mass %;
one or more elements selected from Sb, Sn, Bi, Ge, Te, and Se such that the total content of the one or more elements is in the range of 0.002% or more and 0.030% or less, by mass %; and
Fe and incidental impurities;
thereafter performing finish rolling with a finishing temperature in the range of 900° C. or higher;
coiling the hot-rolled steel sheet at a coiling temperature in the range of 500° C. to 750° C.;
thereafter heating and holding the coiled steel sheet at a temperature equal to the Ac1 transformation temperature or higher for a holding time in the range of 0.5 hours or more;
cooling the heated steel sheet to a temperature lower than the Ar1 transformation temperature at a cooling rate in the range of 1° C./h or more and 20° C./h or less; and
holding the steel sheet at a temperature lower than the Ar1 transformation temperature for a period in the range of 20 hours or more,
wherein the high-carbon hot-rolled steel sheet has (i) a microstructure including ferrite and cementite, a density of the cementite in the ferrite grains being in the range of 0.10 pieces/$\mu m^2$ or less, (ii) a hardness in the range of 65 or less in terms of HRB, and (iii) a total elongation in the range of 40% or more, and
an absolute value of an in-plane anisotropy ($\Delta r$) of an r value of the high-carbon hot-rolled steel sheet is in the range of 0.15 or less.

4. A method for manufacturing a high-carbon hot-rolled steel sheet, the method comprising:

performing hot rough rolling on a steel having a chemical composition comprising:
C: 0.20% or more and 0.48% or less, by mass %;
Si: 0.10% or less, by mass %;
Mn: 0.50% or less, by mass %;
P: 0.03% or less, by mass %;
S: 0.010% or less, by mass %;
acid-soluble Al: 0.10% or less, by mass %;
N: 0.0050% or less, by mass %;
B: 0.0005% or more and 0.0050% or less, by mass %;
one or more elements selected from Sb, Sn, Bi, Ge, Te, and Se such that the total content of the one or more elements is in the range of 0.002% or more and 0.030% or less, by mass %;
at least one element selected from Ni, Cr, and Mo such that the total content of the at least one element is in the range of 0.50% or less, by mass %; and
Fe and incidental impurities;
thereafter performing finish rolling with a finishing temperature in the range of 900° C. or higher;
coiling the hot-rolled steel sheet at a coiling temperature in the range of 500° C. to 750° C.;
thereafter heating and holding the coiled steel sheet at a temperature in the range of the Ac1 transformation temperature or higher for a holding time in the range of 0.5 hours or more;
cooling the heated steel sheet to a temperature lower than the Ar1 transformation temperature at a cooling rate in the range of 1° C./h or more and 20° C./h or less; and
holding the steel sheet at a temperature lower than the Ar1 transformation temperature for a period in the range of 20 hours or more,
wherein the high-carbon hot-rolled steel sheet has (i) a microstructure including ferrite and cementite, a density of the cementite in the ferrite grains being in the range of 0.10 pieces/$\mu m^2$ or less, (ii) a hardness in the range of 65 or less in terms of HRB, and (iii) a total elongation in the range of 40% or more, and
an absolute value of an in-plane anisotropy ($\Delta r$) of an r value of the high-carbon hot-rolled steel sheet is in the range of 0.15 or less.

5. The high-carbon hot-rolled steel sheet according to claim 1, wherein a difference between an N content in a surface layer of the steel sheet within a depth of 150 μm in a thickness direction and an average N content in the entire steel sheet is 30 mass ppm or less.

6. The high-carbon hot-rolled steel sheet according to claim 1, wherein a ratio of an amount of a solute B, by mass %, to the amount of B, by mass %, in the steel sheet is 75% or more.

* * * * *